US006426387B1

(12) United States Patent
Kim

(10) Patent No.: US 6,426,387 B1
(45) Date of Patent: Jul. 30, 2002

(54) GOLF BALL CORE

(75) Inventor: Hyun Jin Kim, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/631,566

(22) Filed: Aug. 4, 2000

(51) Int. Cl.[7] ..... C08L 9/00; A63B 37/06

(52) U.S. Cl. ..... 525/236; 526/340.4; 473/357; 473/361; 473/371; 473/374; 473/377

(58) Field of Search ..... 525/236; 526/340.1; 473/357, 361, 371, 374, 377

(56) References Cited

U.S. PATENT DOCUMENTS 4,955,613 A * 9/1990 Gendreau
5,082,285 A * 1/1992 Hamada
5,215,308 A * 6/1993 Hiraoka

* cited by examiner

*Primary Examiner*—David J. Buttner
(74) *Attorney, Agent, or Firm*—Sheppard, Mullin, Richter & Hampton LLP; Oral Caglar

(57) ABSTRACT

A golf ball core incorporates a cobalt-catalyzed polybutadiene rubber falling within particular specifications for various material values. The material allows for manufacture of a core having a desirable coefficient of restitution and compression properties, while also exhibiting ease of processing. The core also can incorporate a high-cis content, high viscosity polybutadiene rubber to further enhance its coefficient of restitution and compression properties, while maintaining good ease of processing.

26 Claims, No Drawings

GOLF BALL CORE

BACKGROUND OF THE INVENTION

This invention relates generally to a golf ball core and more particularly to golf ball cores comprised of materials that optimize the performance properties of golf balls incorporating the cores.

Golf balls generally are made of a core and at least one cover layer surrounding the core. Balls can be classified as two-piece, multi-layer, or wound balls. Two-piece balls include a spherical inner core and an outer cover layer. Multi-layer balls include a core, a cover layer, and one or more intermediate layers. Wound balls include a core, a rubber string wound under tension around the core to a desired diameter, and a cover layer. For each of these types of ball, the performance of the ball depends in part on the properties of the core. The composition and resulting mechanical properties of the core are important in determining the ball's coefficient of restitution (C.O.R.), i.e., the ratio of the ball's post-impact to pre-impact speed, and its PGA compression, i.e., a measure of the deflection on the surface of the ball when a standard force is applied. A high C.O.R. improves ball speed and distance when hit, and generally, a high C.O.R. is achieved by having a high PGA compression.

Golf ball cores generally are made from blends of polybutadiene rubbers. As noted above, it is desirable that these cores have a high C.O.R. for optimum performance of the ball incorporating the core. It is the conventional wisdom that to achieve a high C.O.R. in ball cores, the cores should be comprised of polybutadiene rubber having a high content of 1,4 cis-polybutadiene (referred to as the "cis-content") and high Mooney viscosity. Current practice favors use of materials with cis-content over 96% and Mooney viscosity around 50. Also, rubbers that are lanthanide-catalyzed, particularly neodymium-catalyzed, have been preferred for use in maximizing core C.O.R., while those catalyzed by other metals, such as cobalt, have not been thought of as best for high C.O.R. Other characteristics of rubbers used in ball cores generally have not been considered of importance in maximizing C.O.R.

However, use of these high cis-content, high-viscosity polybutadiene rubbers leads to processing difficulties during the manufacture of the ball cores. Also, use of lanthanide-catalyzed materials leads to processing difficulties not present in the use of, for example, cobalt-catalyzed rubbers. These difficulties are apparent in, for example, dispersing ingredient materials during rubber compounding processes and preshaping of the materials prior to molding processes. To overcome these difficulties, the high cis-content and high-viscosity lanthanide-catalyzed polybutadiene rubbers typically are blended either with polybutadiene rubbers having low cis-content and Mooney viscosity, or with other types of low viscosity rubber, such as trans-polybutadiene, polyisoprene, or low molecular weight liquid rubber. Blending with these rubbers improves ease of processing of the core material, but it also leads to lowering of the C.O.R. and the performance of the resulting golf ball.

There remains a need for a golf ball core having a high C.O.R. and good performance, without the processing difficulties associated with current materials generally used. The present invention fulfills this need and other needs, and provides further related advantages.

SUMMARY OF THE INVENTION

The present invention is embodied in a golf ball core incorporating a cobalt-catalyzed polybutadiene rubber having: a mean molecular weight of at least about 300,000; a molecular weight distribution of at most about 3 and preferably at most about 2.5; a 1,4 cis-polybutadiene content of at least about 90%, preferably at least about 94%, and most preferably at least about 96%; a Mooney viscosity of at most about 50, and a linearity index of at least about 0.8 and preferably at least about 0.85.

The present invention also is embodied in a golf ball core incorporating the cobalt-catalyzed rubber specified above and a polybutadiene rubber having a Mooney viscosity greater than about 50, and a cis content of at least about 96%. This second rubber preferably is catalyzed by cobalt, nickel, tin, or a lanthanide, most preferably by neodymium. In this embodiment of the invention, the ball core preferably incorporates up to about 50% of the second rubber, more preferably up to 40% of the second rubber, and most preferably up to 30% of the second rubber.

Ball cores of the present invention preferably have PGA compressions of from about 25 to 110, and more preferably from about 40 to 100. Ball cores within the scope of the present invention may be used in golf balls having wound thread layers, intermediate layers, multiple cores, or combinations of the three in various physical configurations. The specified cobalt-catalyzed polybutadiene rubber can be incorporated into inner cores, outer cores, or both. In a preferred embodiment, a golf ball has a core incorporating the specified cobalt-catalyzed polybutadiene rubber, a wound thread layer, an intermediate layer made from thermoplastic resin, and a cover layer. In another preferred embodiment, a golf ball has an inner core incorporating thermoplastic resin and an outer core incorporating the specified cobalt-catalyzed polybutadiene rubber.

The present invention also is embodied in a golf ball core comprising the above-specified cobalt-catalyzed polybutadiene rubber, and a neodymium-catalyzed rubber having a Mooney viscosity of about 63 and a 1,4 cis-polybutadiene content of at least about 97%.

Other features and advantages of the present invention should become apparent from the following detailed description of the invention.

DESCRIPTION OF THE PREFERRED EMBODIMENTS

The present invention is embodied in a core for a golf ball incorporating a cobalt-catalyzed polybutadiene rubber having specified material characteristics. The present invention also is embodied in a core for a golf ball further incorporating polybutadiene rubber having high cis content and high Mooney viscosity, catalyzed by cobalt, nickel, titanium, or a lanthanide, particularly neodymium.

As discussed above, prior practice in the manufacture of golf ball cores has been to focus on using high cis-content, high-viscosity, lanthanide-catalyzed butadiene rubber to achieve a high C.O.R., without considering other characteristics of the core materials. It has become surprisingly apparent that several other material properties, in combination with cis content, lead to a core having high C.O.R. and ease of processability. In the present invention, materials are selected outside the scope of those generally preferred for ball cores, based on consideration of these other material characteristics. These characteristics include the material's catalyzation, molecular weight, molecular weight distribution, Mooney viscosity, and linearity index. Molecular weight distribution of a polymer is defined as the ratio of the polymer's weight average molecular weight to its number average molecular weight. Linearity index is a measure of the ratio of branched polymer chains to linear polymer chains in a polymer. The linearity index (L.I.) of a polymer is determined by the following equation:

$$L.I.=(\text{dilute solution viscosity})/(\text{Mooney viscosity } 1+4\ @100^\circ C./3.5)^{0.3623}$$

To resolve the difficulties in processing ball cores comprising high cis-content, high-molecular weight polybutadiene rubber without sacrificing the superior performance of these cores, the present invention uses polybutadiene rubbers having cis-content lower than that generally used in ball cores and high molecular weight, but low Mooney viscosity. The present invention is embodied in a golf ball core comprising a cobalt-catalyzed polybutadiene rubber having the following properties: a cis content of at least about 90%, preferably higher than about 94%, and most preferably higher than about 96%; a Mooney viscosity less than about 50; a weight-average molecular weight of about 300,000 or greater; a molecular weight distribution of less than about 3, and preferably less than about 2.5; and a linearity index greater than about 0.8, and preferably greater than about 0.85. For comparison, polybutadiene rubbers currently used in the manufacture of ball cores generally have linearity indices of about 0.75 and Mooney viscosities greater than 50. A particular preferred cobalt-catalyzed polybutadiene rubber that falls within these specifications is KA 8855, manufactured by Bayer Corporation. However, other cobalt-catalyzed polybutadienes meeting the above-specified material properties also fall within the scope of the current invention.

Use of a polybutadiene rubber meeting these specifications produces a ball core having a good C.O.R., while retaining ease of processing of the core materials. Cores using this rubber can be made in various sizes and having various PGA compressions by adjusting the loading of non-rubber components within the core composition, while retaining good C.O.R. In particular, ball cores having PGA compressions ranging from about 25 to 110 can be produced using materials within the scope of the present invention. In general, it is easier to produce ball cores having both high C.O.R. and high PGA compression than it is to produce cores having high C.O.R. and low PGA compression. However, because high C.O.R. and low compression lead to a ball having high speed and good playability, this combination of characteristics is highly desirable.

Another aspect of the present invention is embodied in ball cores that, in addition to incorporating the above-specified high-linearity polybutadiene rubber, also incorporate polybutadiene rubbers having Mooney viscosity greater than 50 and cis content of at least about 96%. These high-viscosity polybutadiene rubbers can be catalyzed by cobalt, nickel, titanium, tin, or a lanthanide, such as neodymium. Such a blend also can produce ball cores having good ease of processing and high C.O.R. Suitable high-viscosity polybutadienes include Buden 1207 GF and 1208 GF manufactured by Goodyear Rubber, CB22 manufactured by Bayer Corporation, and Neocis BR60 manufactured by Enichem Elastomers. Preferred blends include up to 50% of the high viscosity rubber. Using more of the high viscosity rubber, and therefore less of the specified cobalt-catalyzed rubber, leads to increasing difficulty processing the core material. The combination of ease of processability and high C.O.R. of the specified cobalt-catalyzed rubber allows for use of a high viscosity, high cis-content rubber in the specified range without introducing excessive processing difficulties, while providing for high C.O.R. in the resulting ball core.

The rubbers used in the present invention can be processed using any conventional mixing method, such as a Bambury mixer, calendering, extrusion, or an internal mixer. The cores can further comprise at least one type each of crosslinking agent, co-crosslinking agent, and filler, as well as antioxidants, mold releasing agents, and other processing aids. Golf balls incorporating the present invention may comprise multiple core layers having differing compositions, such as an inner and outer core construction. The specified material is suitable for use in an inner core, in outer core layers, or in both. Cores of the present invention also can effectively be incorporated into golf balls having intermediate layers made of, for example, thermoplastic resins, or into golf balls having wound thread layers, or any combination of these.

EXAMPLE

Golf ball cores having various compositions within the scope of the present invention were prepared. The ball cores incorporated one or both of the following two polybutadiene rubbers. KA 8855, discussed above as an example of a rubber within the scope of the above-specified parameters; and CB22, a neodymium-catalyzed rubber having a cis-content of 97% and a Mooney viscosity of 63, manufactured by Bayer Corporation. The cores also incorporated chemicals currently known for use in ball cores, such as colorants, fillers, and crosslinking agents.

Ball cores were made using rubber incorporating various percentages of KA 8855. Type 1–7 cores were made from rubber incorporating 100% KA 8855, and they represent ball cores consistent with an embodiment of the present invention using only cobalt-catalyzed polybutadiene rubber meeting the material property specifications described above. These ball cores were prepared to have a wide range of PGA compressions by changing the loading levels of the non-rubber components of the cores, as is generally known in making golf ball cores. Type 8–10 cores were made from rubbers incorporating varying percentages of KA 8855 and CB22, ranging from 75% to 25% KA 8855. These cores represent those consistent with an embodiment of the present invention using cobalt-catalyzed polybutadiene rubber, as specified above, combined with a high cis-content and high-viscosity rubber. That is, Type 8–10 cores illustrate the effects of adding a rubber meeting the material parameters discussed above to conventional high cis-content, high-viscosity neodymium-catalyzed golf ball core material. Type 8–10 cores incorporated loading levels of the non-rubber core components identical to that the type 7 cores to allow for observing the effect of changing KA 8855 percentage on PGA compression of the resulting cores. The rubber compositions and results for PGA compression and C.O.R. of the ball cores are shown in Table 1 below. Also, the ease of processing of each of the ball types was reviewed.

TABLE 1

Test Core Compositions and Performance

| Core Type | KA 8855% | CB22% | C.O.R. | PGA Compression |
|---|---|---|---|---|
| 1 | 100 | 0 | 0.804 | 61 |
| 2 | 100 | 0 | 0.800 | 66 |
| 3 | 100 | 0 | 0.810 | 71 |
| 4 | 100 | 0 | 0.811 | 75 |
| 5 | 100 | 0 | 0.815 | 79 |
| 6 | 100 | 0 | 0.818 | 85 |

TABLE 1-continued

Test Core Compositions and Performance

| Core Type | KA 8855% | CB22% | C.O.R. | PGA Compression |
|---|---|---|---|---|
| 7 | 100 | 0 | 0.803 | 60 |
| 8 | 75 | 25 | 0.803 | 77 |
| 9 | 50 | 50 | 0.815 | 79 |
| 10 | 25 | 75 | 0.815 | 78 |

Discussion

The results of the tests shown in Table 1 demonstrate that use of KA 8855 allows for balls to be prepared having a wide range of PGA compressions while maintaining good C.O.R. In particular, it is difficult to process conventional CB22 to produce a core having both a low PGA compression and a high C.O.R. The test balls having from low to high PGA compression all exhibited high C.O.R. and ease of processing of the core material. Therefore, these results indicate that materials within the scope of the present invention are particularly suited for use for making ball cores having a low PGA compression and a high C.O.R.

Observations during manufacture of the cores also showed that the balls exhibited good ease of processing. As a point of comparison, it is known that ball cores made from rubber incorporating 100% CB22 are difficult to process. The use of KA 8855 reduced these processing difficulties significantly. Type 1 cores, made from rubber incorporating 100% KA 8855, were particularly easy to process in comparison to cores made from rubber incorporating 100% CB22, with the ease of processing less pronounced as the proportion of KA 8855 in the cores was decreased. The results of these tests indicate that ball cores made from materials within the scope of the present invention can be used in a wide range of blends to produce ball cores having desired PGA compression and good C.O.R., with ease of processing of the core material.

Although the invention has been disclosed in detail with reference only to the preferred embodiments, those skilled in the art will appreciate that additional compositions for ball cores can be made without departing from the scope of the invention. Accordingly, the invention is defined only by the following claims.

I claim:

1. A golf ball core comprising a cobalt-catalyzed polybutadiene rubber having a mean molecular weight of at least about 300,000, a molecular weight distribution of at most about 3, a 1,4 cis-polybutadiene content of at least about 90%, a Mooney viscosity of at most about 50, and a linearity index of at least about 0.8.

2. The golf ball core of claim 1, wherein the cobalt-catalyzed polybutadiene rubber has a 1,4 cis-polybutadiene content of at least about 94%.

3. The golf ball core of claim 2, wherein the cobalt-catalyzed polybutadiene rubber has a 1,4 cis-polybutadiene content of at least about 96%.

4. The golf ball core of claim 1, wherein the cobalt-catalyzed polybutadiene rubber has a molecular weight distribution of at most about 2.5.

5. The golf ball core of claim 1, wherein the cobalt-catalyzed polybutadiene rubber has a linearity index of at least about 0.85.

6. The golf ball core of claim 1, further comprising a high-viscosity polybutadiene rubber having a Mooney viscosity greater than about 50 and a 1,4 cis-polybutadiene content of at feast about 96%.

7. The golf ball core of claim 6, wherein the high-viscosity polybutadiene rubber is catalyzed by cobalt, nickel, titanium, tin, or a lanthanide.

8. The golf ball core of claim 7, wherein the high-viscosity polybutadiene rubber is catalyzed by neodymium.

9. The golf ball core of claim 6, wherein the golf ball core comprises up to about 50% high-viscosity polybutadiene rubber.

10. The golf ball core of claim 9, wherein the golf ball core comprises up to about 40% high-viscosity polybutadiene rubber.

11. The golf ball core of claim 10, wherein the golf ball core comprises up to about 30% high-viscosity polybutadiene rubber.

12. The golf ball core of claim 1, wherein the golf ball core has a PGA compression of from about 25 to about 110.

13. The golf ball core of claim 12, wherein the golf ball core has a PGA compression of from about 40 to about 100.

14. A golf ball comprising the golf ball core of claim 1, further comprising a layer of rubber thread surrounding the core and a cover layer surrounding the layer of rubber thread.

15. A golf ball comprising the golf ball core of claim 1, further comprising an intermediate layer surrounding the core and a cover layer surrounding the intermediate layer.

16. The golf ball of claim 15, further comprising a layer of rubber thread between the core and the intermediate layer.

17. The golf ball of claim 16, wherein the intermediate layer comprises thermoplastic resin.

18. The golf ball core of claim 1, wherein:

the golf ball core comprises an inner core and one or more outer cores, the inner core and outer cores are concentric; and the inner and outer cores each have compositions different from each other.

19. A golf ball comprising the golf ball core of claim 18, further comprising an intermediate layer surrounding the core and a cover layer surrounding the intermediate layer.

20. The golf ball core of claim 18, wherein the inner core comprises a cobalt-catalyzed polybutadiene rubber having a mean molecular weight of at least about 300,000, a molecular weight distribution of at most about 3, a 1,4 cis-polybutadiene content of at least about 90%, a Mooney viscosity of at most about 50, and a linearity index of at least about 0.8.

21. The golf ball core of claim 18, wherein one or more of the outer cores comprise a cobalt-catalyzed polybutadiene rubber having a mean molecular weight of at least about 300,000, a molecular weight distribution of at most about 3, a 1,4 cis-polybutadiene content of at least about 90%, a Mooney viscosity of at most about 50, and a linearity index of at least about 0.8.

22. A golf ball comprising the golf ball core of claim 21, wherein the inner core comprises thermoplastic resin.

23. A golf ball comprising:

the golf ball core of claim 18, a layer of rubber thread concentric with the core and situated over the inner core; and a cover layer concentric with the core and situated over the layer of rubber thread.

24. The golf ball of claim 23, wherein:

the outer core is situated between the inner core and the layer of rubber thread, and wherein the outer core comprises a cobalt-catalyzed polybutadiene rubber having a mean molecular weight of at least about 300,000, a molecular weight distribution of at most about 3, a 1,4 cis-polybutadiene content of at least about 90%, a Mooney viscosity of at most about 50, and a linearity index of at least about 0.8.

25. The golf ball of claim 23, wherein:

the outer core is situated between the inner core and the layer of rubber thread, and wherein the outer core comprises a cobalt-catalyzed polybutadiene rubber having a mean molecular weight of at least about 300,000, a molecular weight distribution of at most about 3, a 1,4 cis-polybutadiene content of at least about 90%, a Mooney viscosity of at most about 50, and a linearity index of at least about 0.8.

26. A golf ball core comprising a cobalt-catalyzed polybutadiene rubber and a neodymium-catalyzed rubber:

wherein the cobalt-catalyzed rubber has a mean molecular weight of at least about 300,000, a molecular weight distribution of at most about 3, a 1,4 cis-polybutadiene content of at least about 90%, a Mooney viscosity of at most about 50, and a linearity index of at least about 0.8; and wherein the neodymium-catalyzed rubber has a Mooney viscosity of about 63 and a 1,4 cis-polybutadiene content of at least about 97%.

* * * * *